US006016804A

United States Patent [19]

Gleason et al.

[11] Patent Number: 6,016,804

[45] Date of Patent: Jan. 25, 2000

[54] RESPIRATORY MASK AND METHOD OF MAKING THEREOF

[75] Inventors: Colin M. Gleason, Akron; Valentin A. Castro, Williamsville, both of N.Y.

[73] Assignee: Scott Technologies, Inc., Mayfield Heights, Ohio

[21] Appl. No.: 09/177,166

[22] Filed: Oct. 22, 1998

Related U.S. Application Data

[60] Provisional application No. 60/063,151, Oct. 24, 1997.

[51] Int. Cl.[7] ..... A62B 7/10; A62B 18/02; A62B 18/08

[52] U.S. Cl. ..... 128/206.17; 128/205.25; 128/206.12; 128/206.16; 128/206.21; 128/206.28

[58] Field of Search ..... 128/205.27, 205.25, 128/206.12, 206.16, 206.17, 206.21, 206.27, 206.28; 2/206, 454

[56] References Cited

U.S. PATENT DOCUMENTS

| | | | |
|---|---|---|---|
| 4,164,942 | 8/1979 | Beard et al. | 128/146.5 |
| 4,790,306 | 12/1988 | Braun et al. | 128/206.12 |
| 4,951,664 | 8/1990 | Niemeyer | 128/206.24 |
| 4,960,121 | 10/1990 | Nelson et al. | 128/206.24 |
| 5,062,421 | 11/1991 | Burns et al. | 128/205.27 |
| 5,231,982 | 8/1993 | Harrison et al. | 128/207.12 |
| 5,408,995 | 4/1995 | Contino et al. | 128/205.25 |
| 5,592,937 | 1/1997 | Freund | 128/206.16 |
| 5,628,308 | 5/1997 | Harges, Jr. et al. | 128/206.17 |
| 5,794,617 | 8/1998 | Brunell et al. | 128/206.12 |

FOREIGN PATENT DOCUMENTS

| | | |
|---|---|---|
| 309277 | 3/1989 | European Pat. Off. . |
| 2143136 | 2/1985 | United Kingdom . |

*Primary Examiner*—John G. Weiss
*Assistant Examiner*—Todd M. Martin
*Attorney, Agent, or Firm*—Hodgson, Russ, Andrews, Woods & Goodyear, LLP

[57] ABSTRACT

A facepiece insert and facepiece combination suitable for use as a respiratory mask. The respiratory mask may be combined with air purifying cartridges or breathable gas sources such as oxygen reservoirs. The insert is molded flat with living hinges, and the facepiece body is molded onto the insert in sealing engagement.

24 Claims, 8 Drawing Sheets

FIG. 9
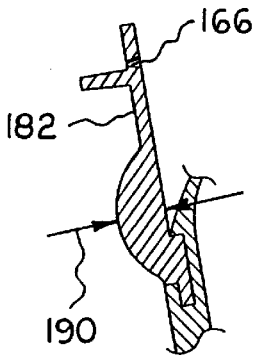
FIG. 8
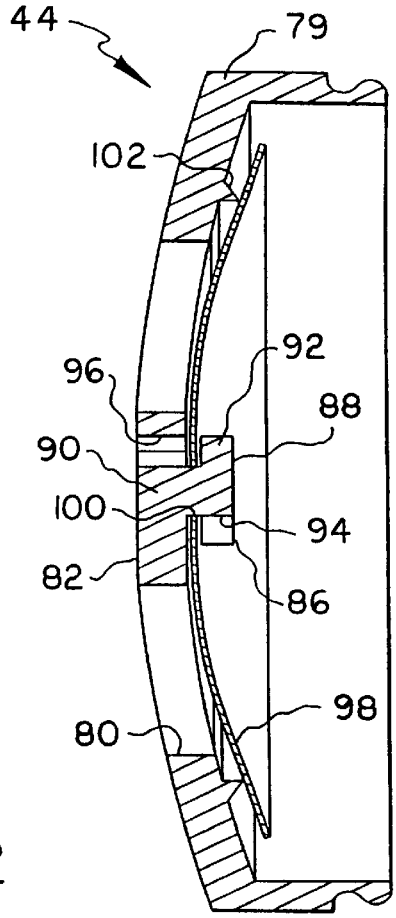
FIG. 13
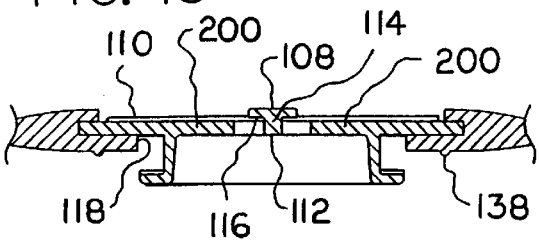
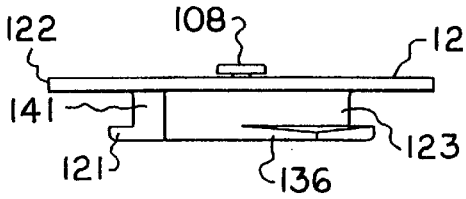
FIG. 12
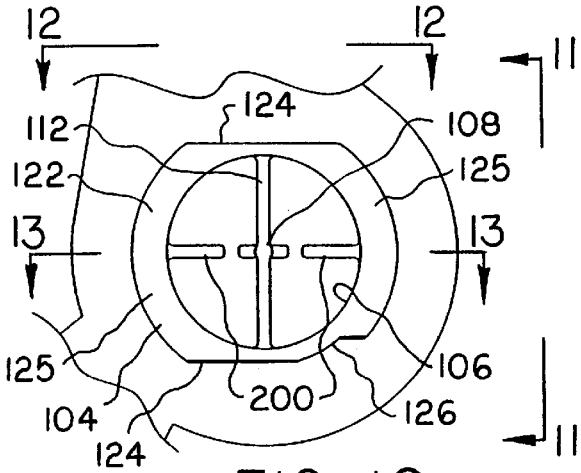
FIG. 10
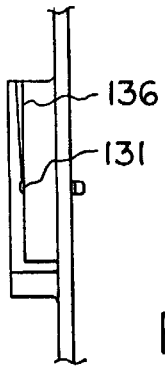
FIG. 11

RESPIRATORY MASK AND METHOD OF MAKING THEREOF

CROSS REFERENCE TO RELATED APPLICATION

Applicants hereby claim priority based on Provisional Application No. 60/063,151 filed Oct. 24, 1997, and entitled, Mask for Respiratory Protection and Method of Making Thereof, which is incorporated herein by reference.

FIELD OF THE INVENTION

The present invention relates generally to respiratory masks and particularly to a facepiece insert and facepiece and a method of making thereof.

BACKGROUND OF THE INVENTION

Respirators and other masks for supplying breathing gas to the user typically have facepieces made of a soft compliant material, such as rubber to form a seal with the user's face. In order to support filters and exhalation valves and the like, some masks have been made so that the rubber is thick, which undesirably makes the mask heavy and uncomfortable to wear, as well as more expensive to manufacture. However, if the rubber thickness is reduced, the mask may tend to collapse onto the user's face especially when the harness is tightened for donning the mask.

U.S. Pat. No. 5,062,421 describes a respirator mask wherein a large single rigid insert serves as a structural member for attachment of filter cartridges and an exhalation valve assembly and for support of the facepiece which is permanently sealed thereto. Each filter cartridge is described as asymmetric and swept back to shift the center of gravity inwardly toward the wearer's head, thus making the mask seem to be lighter to the wearer. This insert has swept-back cheek portions and is otherwise formed to conform to the shape of the mask, i.e., non-flat. Not only is such a mask not flexible enough to provide a comfortable fit over various face sizes but the non-flat insert is difficult to manufacture.

In order to provide a more comfortable fit, U.S. Pat. No. 5,592,937 discloses a respirator mask having a very soft compliant facepiece that has several stiffening elements integrated therein. The stiffening elements include an exhalation valve structure and structures for mounting filter cartridges, respectively. A yoke to which harness straps are attached is placed on top of the facepiece. Such a mask may be more flexible than desired due to the rubber material between the elements. Although the elements are flat, the requirement of more than one of them, as well as the requirement of the yoke, undesirably increases the manufacturing costs.

Accordingly, what is needed is a mask that is inexpensive to manufacture and that provides a comfortable sealing fit over various face sizes while having sufficient rigidity so that it does not collapse during normal use.

SUMMARY OF THE INVENTION

The present invention meets the above-described need by providing a single piece of rigid material that is molded flat with living hinges and with means for attaching one or more air purifying filters or cartridges or hoses for supplying breathing gases. The single piece is bent or folded along the living hinges into a shape conforming to the mask shape and a face seal of pliable material is molded thereto to form a facepiece. The living hinges allow flexure of the finished mask for fitting comfortably to various face sizes. A harness attachment is preferably molded integrally with the single piece of rigid material.

The above and other objects, features, and advantages of the present invention will be apparent from the following detailed description of a preferred embodiment of the present invention when read in conjunction with the accompanying drawings wherein the same reference numerals designate the same or similar parts throughout the several views.

BRIEF DESCRIPTION OF THE DRAWINGS

FIG. 8 is a sectional view of the exhalation valve structure, with the exhalation valve mounted thereon, taken along lines 8—8 of FIG. 5.

FIG. 9 is a sectional view of a harness attachment portion of the insert taken along lines 9—9 of FIG. 5.

FIG. 10 is an outside plan view of a filter cartridge attachment structure therefor.

FIG. 11 is a side view thereof taken along lines 11—11 of FIG. 10.

FIG. 12 is a side view thereof taken along lines 12—12 of FIG. 10.

FIG. 13 is a sectional view thereof taken along lines 13—13 of FIG. 10.

DETAILED DESCRIPTION OF THE PREFERRED EMBODIMENT

Figure 1:
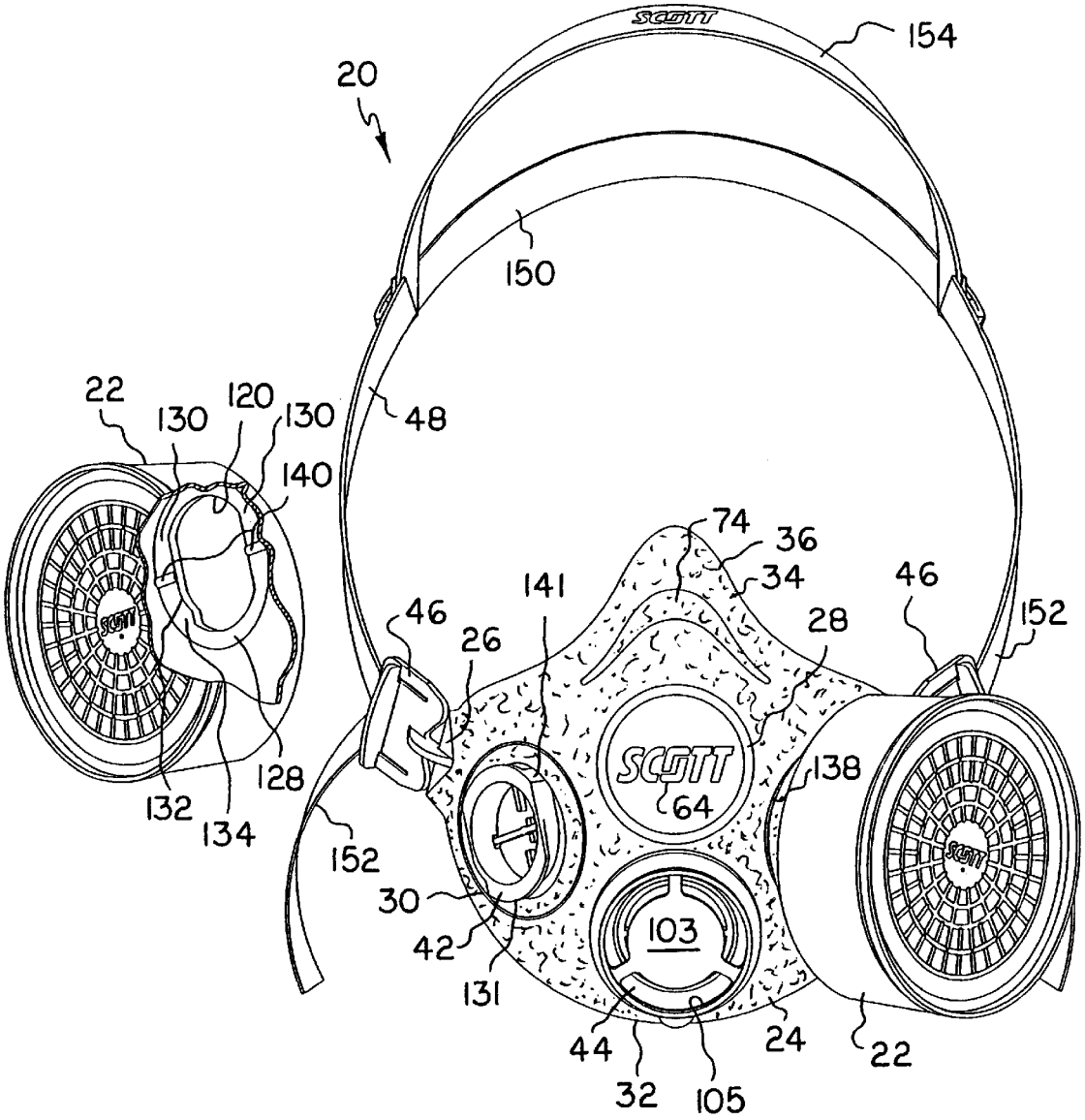
FIG. 1 is an outside perspective, partially exploded, view of a mask which embodies the present invention, with a portion of a filter cartridge removed and with valves not shown for ease of illustration.

While the mask described herein is a half facemask, i.e., it is constructed to cover the mouth and nose but not the eyes, it should be understood that a mask which embodies the present invention may alternatively be a full facemask; i.e., it is constructed to cover the eyes as well as the mouth and nose or a quarter mask; i.e., it is constructed to cover the nose and mouth but not extend under the chin; or it may be another type of face covering. In addition, while the mask described in connection with the preferred embodiment is constructed for attachment of air purifying cartridges to serve as a respirator, it should be understood that a mask which embodies the present invention may alternatively be constructed for attachment of hoses for delivering oxygen or other breathable gas.

Referring to the drawings, there is shown generally at 20 a half facemask for covering the nose and mouth of a person for protecting the person from airborne contaminants by means of air purifying cartridges or filters 22. As used herein and in the claim(s), "breathing gas" is meant to include air which has been filtered or otherwise treated so that airborne contaminants are removed therefrom, as well as oxygen or other breathing gas supplied from a source.

While the mask 20 is shown to have two air purifying cartridges 22 (one on each of the swept-back sides) to provide a large total area to breathe through so that the breathing resistance is desirably minimized, it should be understood that, in accordance with the present invention, the mask need be provided with only one such cartridge 22. It should also be understood that the mask may be provided with more than two cartridges 22. Various types of cartridges (some containing gas absorbents and others containing mechanical filters and others containing both) may be interchangeably attached to the mask (as long as each of the cartridges attached to a mask is of the same type), and the mask should be fitted for a particular use with the type of cartridge that is suitable for removing the particular contaminants in the environment at the time of use. It should also be understood that there may be one or more exhalation valves, that a tube may be used to carry off exhaled gases, that an antisuffocation valve may be used, and that a separate passageway for exhalation gases may not be required as the gas inlet could be designed to handle the egress of exhalation gases on a part-time basis.

The mask 20 is formed of a faceseal or body 24 composed of a suitable soft pliable material, described hereinafter, for comfortably as well as sealingly engaging the face of a user and is further formed of a member or insert 26 composed of a single piece of thin rigid material, such as, for example, polypropylene, which is lightweight, low-cost, and strong, or other suitable plastic. The insert 26 may be made more inexpensively as a single piece than if it were necessary to make several insert pieces. The body 24 is molded or otherwise suitably sealingly attached to the insert 26, and the composite mask suitably shaped to suitably and sealingly fit a user's face; i.e., it has a front portion 28, the two swept-back cheek portions 30, a lower swept-back portion 32 for engaging the chin of the user, and an upper swept-back portion 34 for covering the nose and engaging the bridge of the nose. The nose portion 34 sweeps downwardly from the bridge of the nose on each side so as not to obstruct the vision of the user. The perimetric portion 36 of the body 24 is folded inwardly of the mask to provide a sealing edge 38 (FIG. 3) for sealingly yet comfortably engaging the user's face all around the perimeter of the mask. Thus, a breathing cavity 40 is provided between the mask and the user's face wherein the user's nose and mouth are isolated from the outside environment so that only the gases provided by the cartridges 22 are available for breathing. At 23 is a chin perspiration slot; i.e., a hole in the chin area on the inside of the mask to allow perspiration which may form on the user's skin during use to drain into the mask cavity to improve wear or comfort.

The rigid insert 26 is formed to have structure 42 for attachment of the cartridges 22. The rigid insert 26 is also formed to have an exhalation valve structure 44 (on the chin portion 32 of the mask) and harness adjusters 46 (on the cheek portions 30 of the mask) for attachment of a harness 48. These structures will be discussed in greater detail hereinafter.

The material of which the mask body 24 is composed is selected to have a suitable firmness so that it doesn't "cave-in," yet has a good feeling against the face of the user. It is also desirable that the material be minimally prone to compression set and be light in weight. Other desirable features include good processing times, compatibility with the molding process, good environmental resistance, and low cost. For example, the mask body 24 may be composed of a thermoplastic rubber, such as Sanoprene rubber provided by Monsanto Company, having the thickness otherwise described herein and having a durometer hardness, on the Shore A scale, of about 45 to 60 (preferably 55 to 60). The mask body 24 may be composed of other suitable elastomeric materials such as silicones, chloroprene rubber, other natural or synthetic rubbers, or mixtures thereof.

Figure 4:
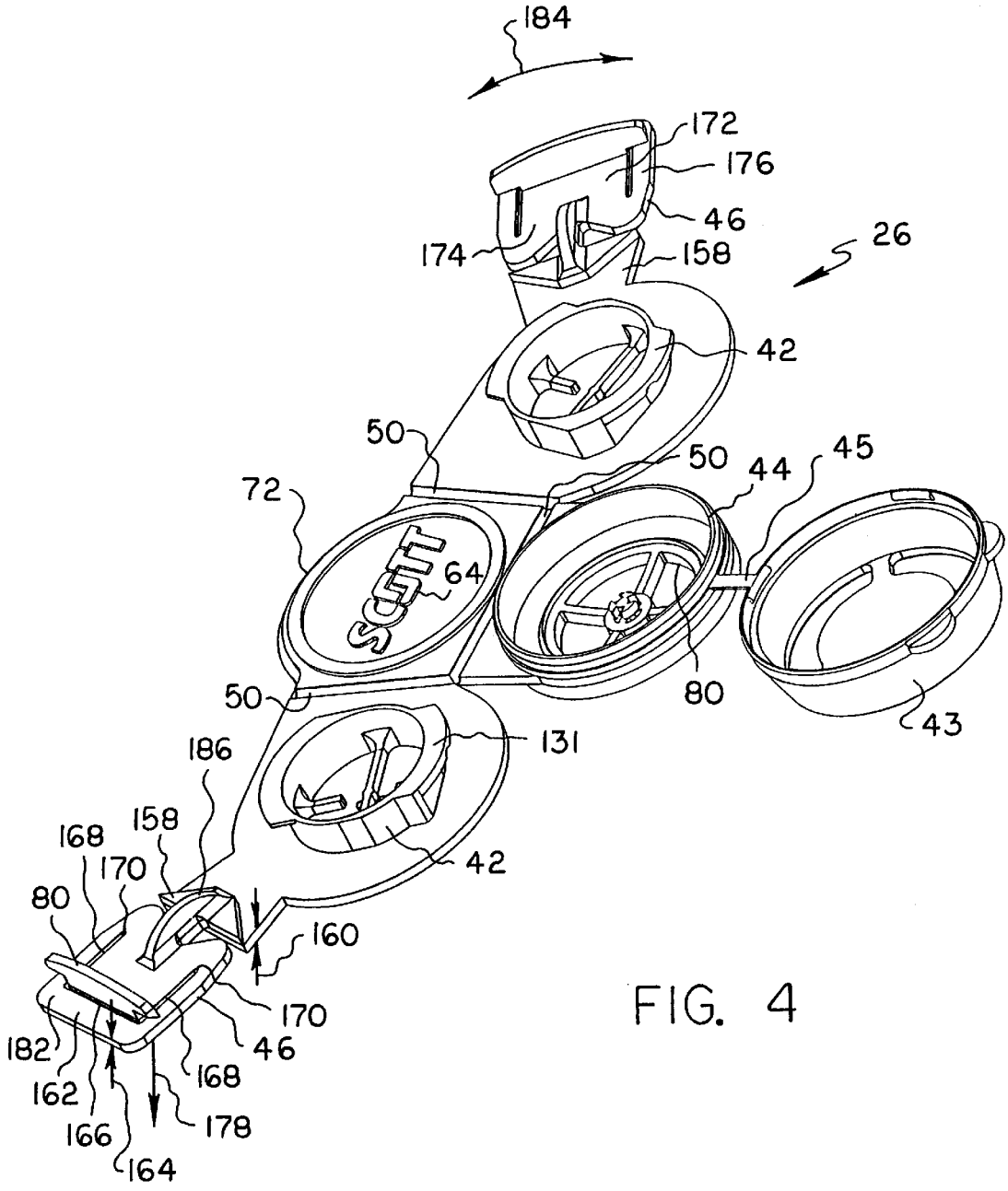
FIG. 4 is an outside perspective view of the insert member thereof, in a flat form.
Figure 5:
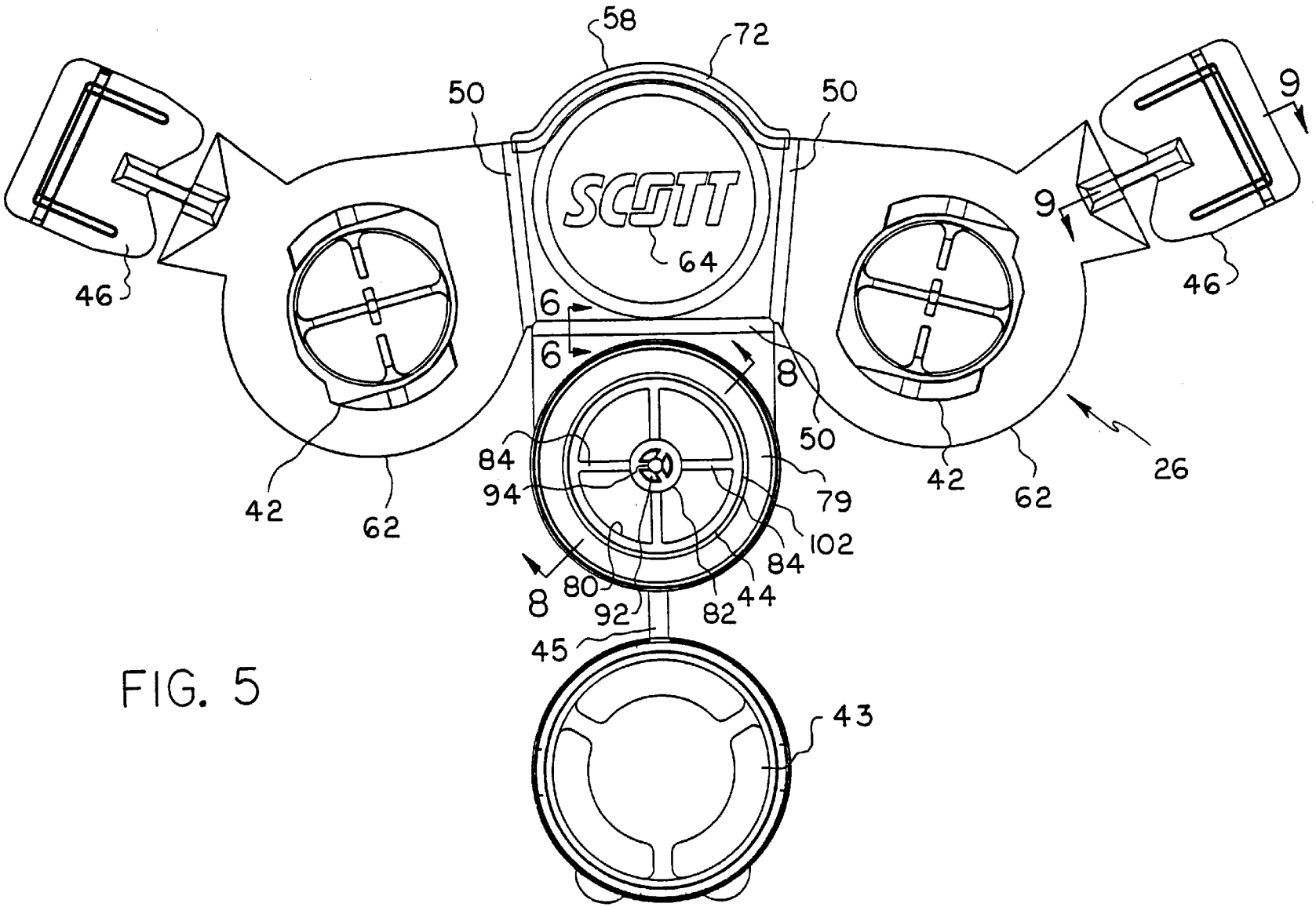
FIG. 5 is an outside plan view of the insert, in a flat form.
Figure 7:
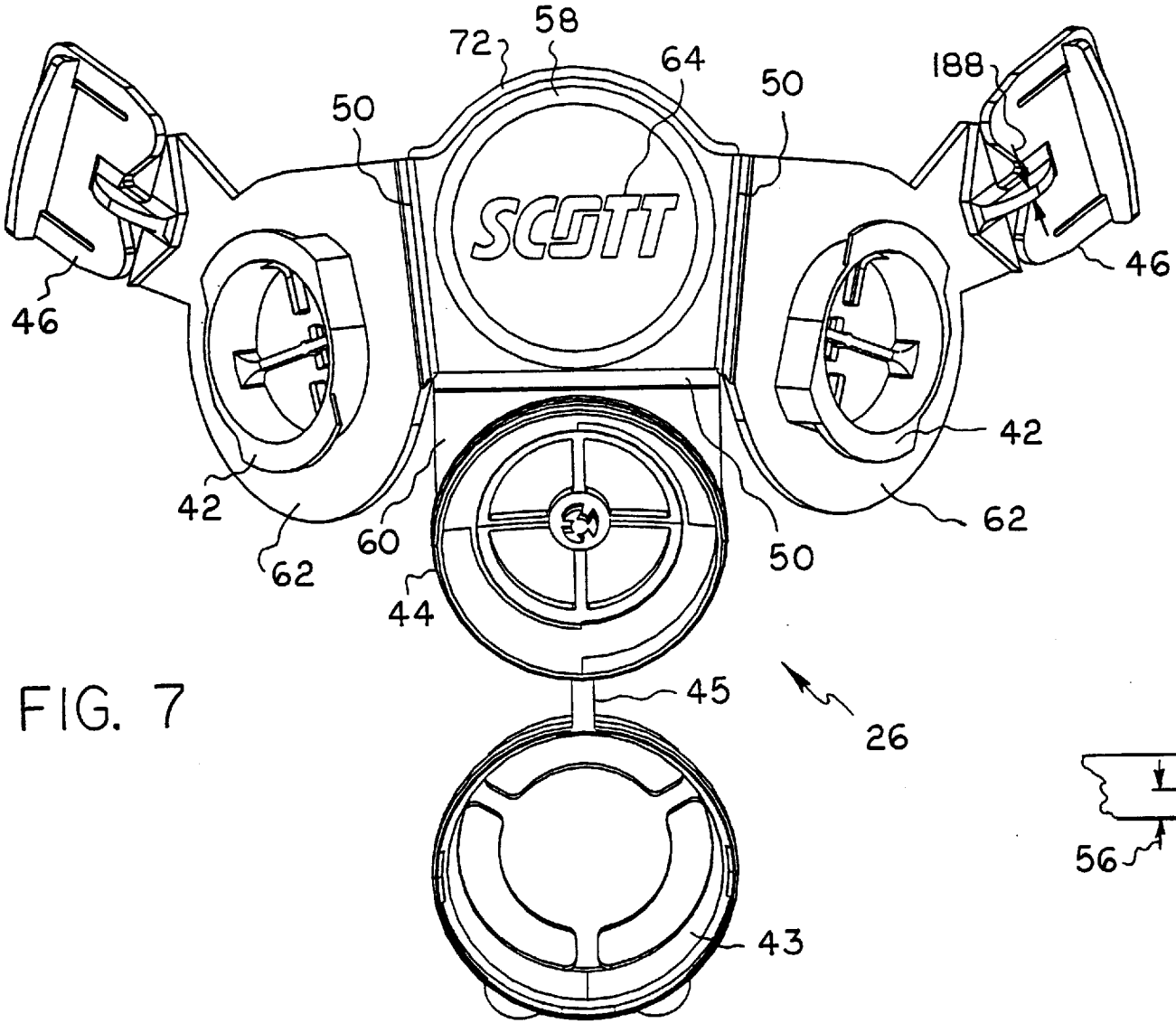
FIG. 7 is an outside perspective view of the insert which has been bent to a shape conforming to the mask shape for molding of the facepiece thereto.

The insert is molded flat, as illustrated in FIGS. 4 and 5, so that it may be molded more inexpensively than if it were molded in the shape, illustrated in FIG. 7, which conforms to the shape of a face and which the mask ultimately takes.

Figure 6:
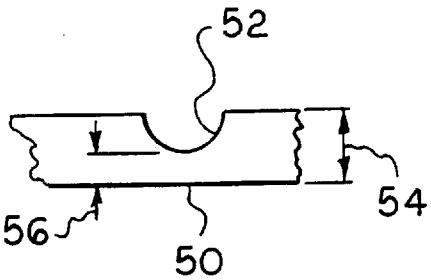
FIG. 6 is a sectional view of a portion of the insert taken along lines 6—6 of FIG. 5.

In order to bend or fold the rigid insert 26 to the desired shape (FIG. 7) for molding of the body 24 thereto, in accordance with the present invention, living hinges, illustrated at 50, or other suitable means are formed in the insert 26 to allow bending or folding of the rigid insert 26. A living hinge 50 is a line of reduced thickness defined by a groove, illustrated at 52 in FIG. 6, which reduces the insert thickness sufficiently for such bending to occur. The groove 52 should be radiused (rounded) so that bending, rather than breaking, occurs. For example, the insert thickness, illustrated at 54 (exclusive of increased thicknesses for the cartridge attachment, exhalation valve, and harness adjuster structures and the like), may be about 0.07 inch, and the reduced insert thickness, illustrated at 56, at the groove 52 may be about 0.015 inch. As seen in FIG. 7, the insert 26 has a portion 58 corresponding to the front portion 28 of the mask, a portion 60 corresponding to the chin portion 32 of the mask and defined by a living hinge 50 therebetween, and a pair of portions 62 corresponding to the cheek portions 30, respectively, of the mask and defined by a pair of living hinges 50. A cartridge attachment structure 42 and a harness adjuster 46 are integrally molded in each of the cheek portions 62, the exhalation valve structure 44 is integrally molded in the chin portion 60, and a logo, illustrated at 64, may be applied to the front portion 58. The logo area 58 alternatively may be used for additional attachments, such as a third cartridge, a device to transmit sound, an antisuffocation valve, or electronic attachments and the like. As shown in FIGS. 4–6, the insert 26 preferably includes an integrally molded exhalation cap 43 that is connected to the insert 26 by a bridge portion 45 that is flexible such that it bends when the cap 43 is placed over the exhalation valve structure 44. The bridge portion 45 may include a frangible section for removing the cap 43 when it is not used.

Figure 2:
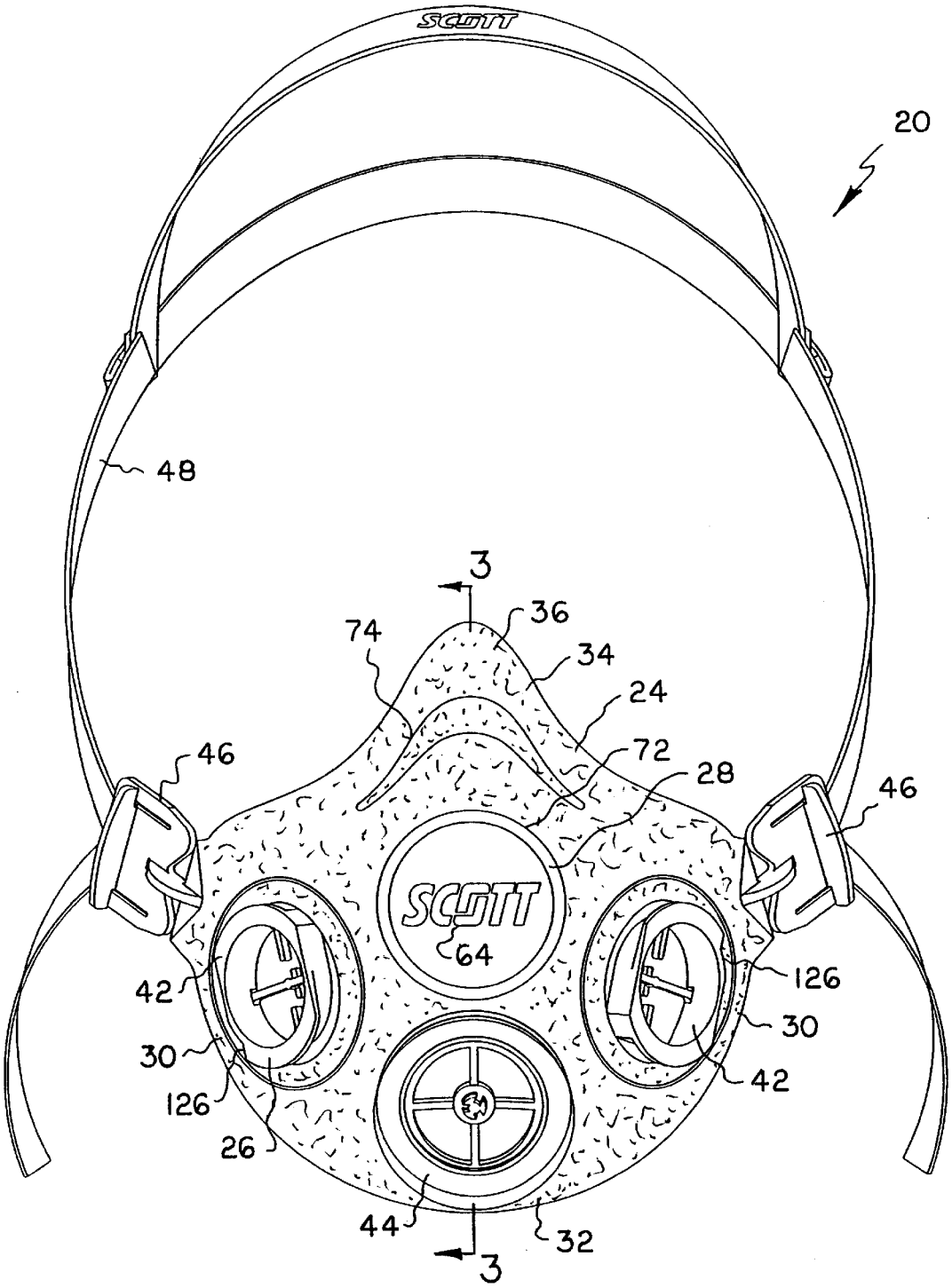
FIG. 2 is an outside perspective view thereof with the filter cartridges and exhalation valve cover removed.
Figure 3:
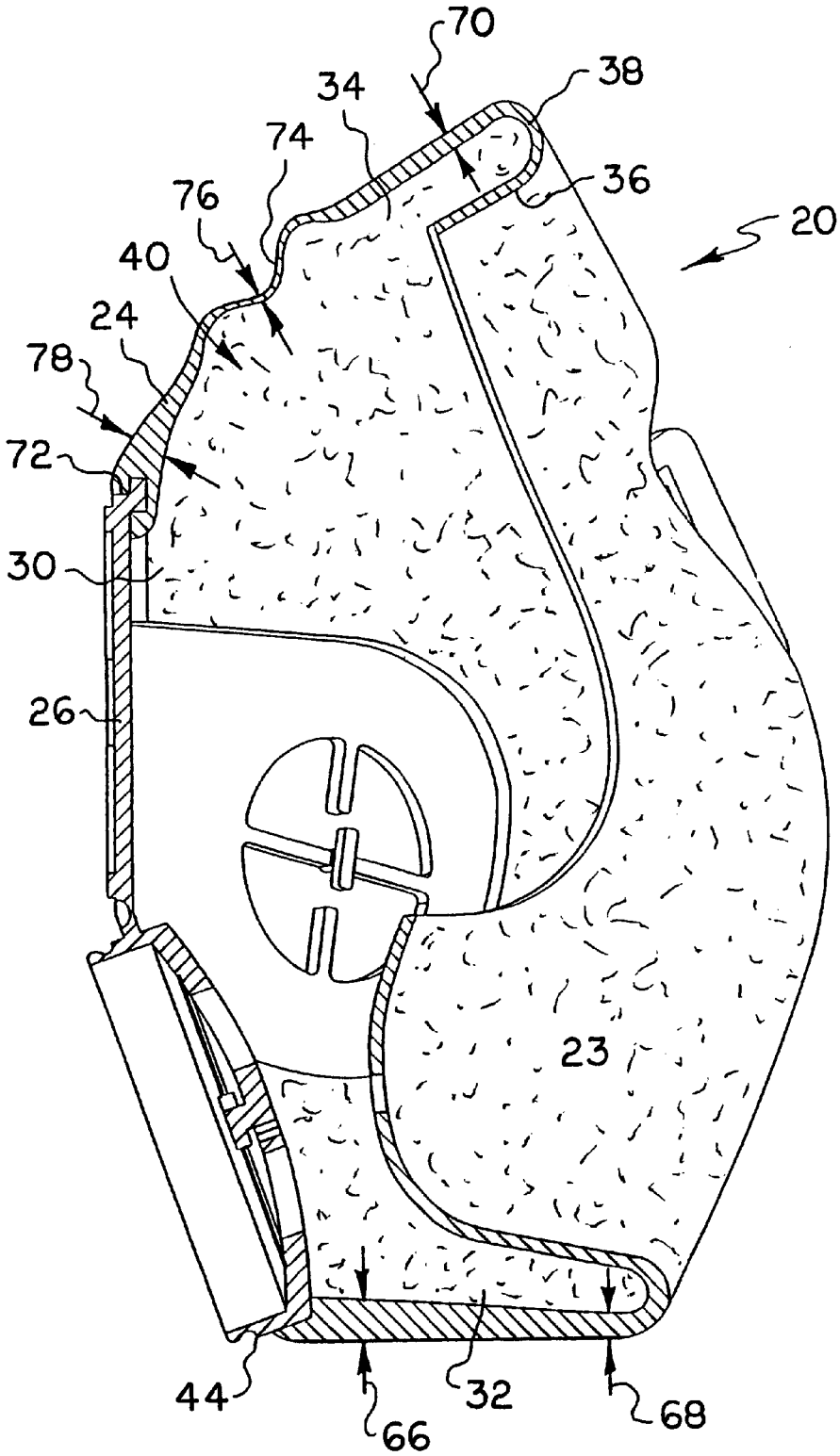
FIG. 3 is a sectional view thereof taken along lines 3—3 of FIG. 2.

With the molded insert 26 folded or bent into the desired form (FIG. 7), it is inserted in a mold and the body 24 of elastomeric material molded to the insert 26, as illustrated by stippling in FIGS. 1, 2, and 3, leaving the cartridge attachment, exhalation valve, and harness attachment structures 42, 44, and 46, respectively, free of the elastomer.

The body 24 is molded to minimize its thickness for the user's comfort and to minimize cost of material, yet to have sufficient thickness to prevent collapse when the mask is donned, and its thickness may vary, as seen in FIG. 3. Thus, for example, in the chin area, the body 24 may have a thickness, illustrated at 66, of about 0.14 inch which tapers to a thickness, illustrated at 68, of about 0.065 inch at the edge 38. For another example, the body 24 may have a thickness, illustrated at 70, of about 0.055 inch with an increased thickness at its attachment to the insert 26. The edge of the insert 26 may be suitably notched, as illustrated at 72, to provide an enlarged portion or shelf around which the body is molded to mechanically interlock the body 24 to the insert 26. For attachment of the body 24 to the notched edge of the insert 26, the thickness of the body 24 may increase to a thickness, illustrated at 78, of, for example, about 0.18 inch.

In order to provide some decoupling of forces of the mask to the nose region of the user's face for increased comfort, the body 24 is preferably provided with a convoluted and reduced thickness portion 74 across the nose portion 34 and running generally parallel to the edge 38. Thus, the convoluted portion 74 is provided to allow some controlled collapsing of the body material in the convoluted portion to reduce the pressure on the user's nose of the effects of tightening the mask on the face. For example, the thickness, illustrated at 76, of the body 24 at the convoluted portion 74 may be reduced to about 0.03 inch.

Referring to FIG. 8, the exhalation valve structure 44 is formed to have a raised body portion 79 having a circular opening, illustrated at 80, through which expired breath is released. A centrally disposed hub portion 82 is supported in the opening 80 by a plurality, such as four narrow spokes 84 (shown in FIG. 5) extending from the periphery of the opening 80 and spaced generally equally circumferentially thereabout. A button 86 is formed on the outer surface of the hub portion 82. The button 86 is shown to have a raised portion 88 and a central shaft 90 which connects the raised portion 88 to the hub 82. The raised portion 88 is shown to have three circumferentially spaced projections 92 separated by cut-outs, illustrated at 94. The hub portion 82 is shown to have cut-outs, illustrated at 96, which underlie the projections 92, respectively, entirely. The use of cut-outs 94 and 96 allows the molding process to be simplified. Thus, instead of using mold inserts to provide during molding the space between the hub 82 and the button 86, some of the material (cut-outs 94) of the button and some of the material (cut-outs 96) of the hub is "sacrificed" so that mold portions can reach into this otherwise inaccessible "overhung" area, without sacrificing the integrity of the hub or the button.

In order to prevent contaminated air from the environment from entering the breathing space 40 during inhalation, a flapper valve in the form of a thin circular disc 98 of rubber or other suitable material having a central aperture 100 is received to cover the opening 80 to act as a check valve. The valve 98 is "buttoned" to the hub 82 by stretching it at the aperture 100 over the button 86 so that the shaft 90 is received in the aperture 100 and the valve securely lies between the hub 82 and the button 86. The exhalation valve body 79 is molded to provide a circular raised ridge 102 on its outer surface and spaced radially outwardly of the opening 80 to be engaged by the valve disc 98 so as to provide a secure seal against the entrance of contaminated air from the environment during inhalation. However, the valve disc is unrestrained for movement outwardly so that exhaled air may freely pass outwardly through the opening 80 during exhalation. As seen in FIG. 1, the exhalation valve structure 44 may be suitably fitted with a protective cover 103 which is suitably formed with passages, illustrated at 105, for passage of exhalation gas. However, as stated above, a separate exhalation valve is not required for all masks and inserts.

Referring to FIGS. 10 to 13, the inhalation cartridge attachment structures each includes a body 104 having a circular opening, illustrated at 106, for receiving into the cavity 40 breathing air from the respective cartridge 22. A centrally disposed button 108, for receiving a flapper valve disc 110, which may be similar to valve disc 98, is supported by a narrow member 112 which extends across the opening 106. The button 108 is raised inwardly (toward the cavity 40) from the member 112 and connected thereto by a centrally disposed shaft 114. The valve disc 110 has a centrally disposed aperture, illustrated at 116, wherein the disc 110 is stretched over the button 108 so that the shaft 114 is received in the aperture 116 to securely hold the valve disc. Cut-outs 118 are provided in the valve body 104 for ease of molding similarly as previously described relative to cut-outs 94 and 96 for the exhalation valve structure. The valve disc 110 acts as a check valve to allow breathing air from the respective cartridge 22 into the breathing cavity 40 during inhalation, but is desirably restrained by the valve body 104 from allowing exhaled air from passing outwardly and into the respective cartridge 22 and thus preventing moisture from the user's breath from getting into the cartridge materials. A pair of narrow members 200 extend from the valve body 104 into the opening 106 and are oriented generally at right angles to member 112 to support the valve disc 110 against its movement outwardly during exhalation and thus afford a better seal with the valve body 104 during exhalation. It should, however, be understood that a mask in accordance with the present invention need not contain an inhalation valve.

Each of the cartridges 22 is circular (but may be otherwise suitably shaped) and has in its engaging wall 128 an opening, illustrated at 120, which communicates with inhalation opening 106 for the delivery of breathing gas to breathing cavity 40. In order to maximize cartridge volume and maximize the user's view, the cartridges 22 are provided with off-center positions for the openings 120, and the means of attachment are formed so that the cartridges 22 are positioned toward the read of the mask 20 (swept back) when attached, as seen in FIG. 1.

The adapter 104 for receiving a cartridge 22 comprises a lower floor 121 and a raised lip 122, which is vertically spaced from the floor 121 and connected thereto by a cylindrical portion 123 which defines the opening 106. The adapter 104 is a quarter-turn bayonet-mount necessitating only 90 degrees rotation for the respective cartridge to lock into place, as hereinafter discussed. The lip 122 is truncated on one pair of opposite sides, as illustrated at 124, leaving a pair, at 90 degrees thereto, of opposite circular portions 125 which extend radially (from the center of opening 106) farther than the distance radially which the truncated portions 124 extend. One of the truncations 124 is further formed to have a notch or keyway 126 at one end thereof. The respective cartridge opening 120 has the same shape as that of the lip 122, including a pair of truncated sides 132 and a similarly shaped notch or keyway 134 formed in one of the truncations 132 at one end thereof. When the keyways 126 and 134 are aligned, the lip 122 can be received within the opening 120, and the cartridge was 128 can accordingly be received under the lip 122. By turning the cartridge 90 degrees, the portions 130 of the cartridge wall alongside the cartridge opening truncations 132 are received under the circular portions 125 of the lip 122 to attach the cartridge to the mask. The adapter 104 is formed to have a "stop" portion, illustrated at 141 in FIG. 1, diametrically opposite the keyway 126 for preventing turning of the cartridge in the wrong direction and for preventing further turning of the cartridge 22 beyond this desired point of attachment (beyond 90 degrees). Underneath each of the circular portions 125, the floor 121 is shaped to have a portion or ramp 136 which slopes toward the lip 122 from a circular portion end in the direction of rotation of the respective cartridge 22 for connecting it to the mask. The ramp 136 is thus provided to pinch the cartridge wall 128 as the cartridge is rotated into position and tighten it between the floor 121 and the lip 122 to tighten the cartridge onto the mask. A circular bead or raised ridge 138, which surrounds each inhalation valve adapter 104, is molded into the mask body 24 to sealingly engage a bead (not shown) on the respective cartridge wall 128 to seal the adapter opening to prevent entrance of noxious gases in the environment. The cartridge wall 128 may have two such circular beads, the bead 138 being just outside of the outermost cartridge bead but close enough to sealingly engage therewith. The portion of the mask containing bead 138 is molded flat (so that the outer surface of the body 24 does not slope in the area thereof containing the bead 138) so as to insure a good seal. It should be understood that the bead 138 is not required, and a suitable seal may be obtainable without the bead 138. Raised nubs, illustrated at 140, are provided on each cartridge wall portion 130 (disposed centrally along the length thereof and extending radially from the truncated edges 132, respectively) to mate with corresponding grooves, illustrated at 131 (FIG. 11), on the circular portions 125 to positively "click" the respective cartridge into position for use and to let the user know that it is in such position.

As shown in FIG. 2, the keyways 126 are on the outer (toward the user's ears) truncations, and each inhalation structure 42 will accept the same cartridge with the result that it is desirably unnecessary to have different cartridges for the two structures 42. Thus, for the structure 42 on the viewer's right, in FIG. 2, the cartridge 22 is mounted with the cartridge opening 120 initially at the bottom of the cartridge, and the cartridge is rotated clockwise 90 degrees until the nubs 140 click into position with the cartridge swept back toward the rear to increase the user's vision. For the structure 42 on the viewer's left, the cartridge 22 is mounted with the cartridge opening 120 initially at the top of the cartridge, and the cartridge is rotated clockwise 90 degrees until the nubs 140 click into position with the cartridge swept back toward the rear to increase the user's vision. The cartridges may also be round and may be threaded to engage with a threaded port.

The harness 48 is of a two-point type having a single strap 150 connected at its end portions 152 to harness adjusters 46 for going around the back of the user's head and a second strap 154 sewed to strap 150. Each harness adjuster 46 is a single piece integrally molded to an integral increased thickness portion 158 of the insert 26. For example, portion 158 may have a thickness, of about 0.14 inch. The harness adjuster 46 has a planar portion 162, the thickness, illustrated at 164, of which may be equal to thickness 160, of about 0.07 inch. Portion 162 has a straight slot, illustrated at 166, entirely therethrough which is adjacent and parallel the terminal edge thereof and extends over most of the width thereof. A pair of straight slots, illustrated at 168, extend entirely through portion 162 from the ends of slot 166 along the sides respectively of portion 162 to ends 170 and are of substantially the same length. An imaginary line, illustrated at 174, between ends 170 defines a hinge about which a portion 172 within the boundary between slots 166 and 168 and imaginary line 174 flexes with respect to the rest, illustrated at 176, of portion 162. Flexure of portion 172 in the direction illustrated at 178 is limited by stop member 180 which is integral with portion 172 and extends across portion 172 adjacent to slot 166 and beyond slots 168. The surface 182 from which the stop member 180 extends will be defined herein as the "touter" surface. The end portion 152 of the strap 150 passes outwardly through the slot 166 and out at the outer surface 182. By pulling on strap end portions 152, the buckle portions 172 flex outwardly and the strap 150 can as a result be adjustably tightened onto the user's head. As seen in FIG. 9, the slot 166 is formed so that it is narrower at the outer surface 182 than at the inner surface. When force is applied to pull the strap 150 in the other direction to loosen it, the stop member 180 substantially prevents flexure of the buckle portion 172 inwardly, and the strap 150 is punched between the buckle portions 172 and 176. The harness straps are composed of a suitable resilient material so that they will give when the user's face moves.

In order to adjust the mask to various users' heads, in accordance with the present invention, the harness adjusters 46 are shaped to flex upwardly and downwardly, as illustrated by arrow 184. In order to provide such flexion, a flexible hinge is provided in the form of a member 186 integral with and connecting portion 158 and the planar portion 162. Member 186 is relatively thick in a direction normal to planar portion 162 to provide a suitable beam strength and is relatively thin in a direction parallel to a plane in which planar portion 162 lies to allow the desired flexion in the directions 184. For example, the thickness, illustrated at 188 (FIG. 7), of hinge member 186 in a direction parallel to a plane in which planar portion 162 lies may be about 0.10 inch to allow flexion of buckle in the direction 184. Member 186 is shown to be generally half-moon shaped, and its greatest thickness, illustrated at 190 (FIG. 9), over its length may, for example, be about 0.25 inch to provide the desired beam strength.

Figure 14:
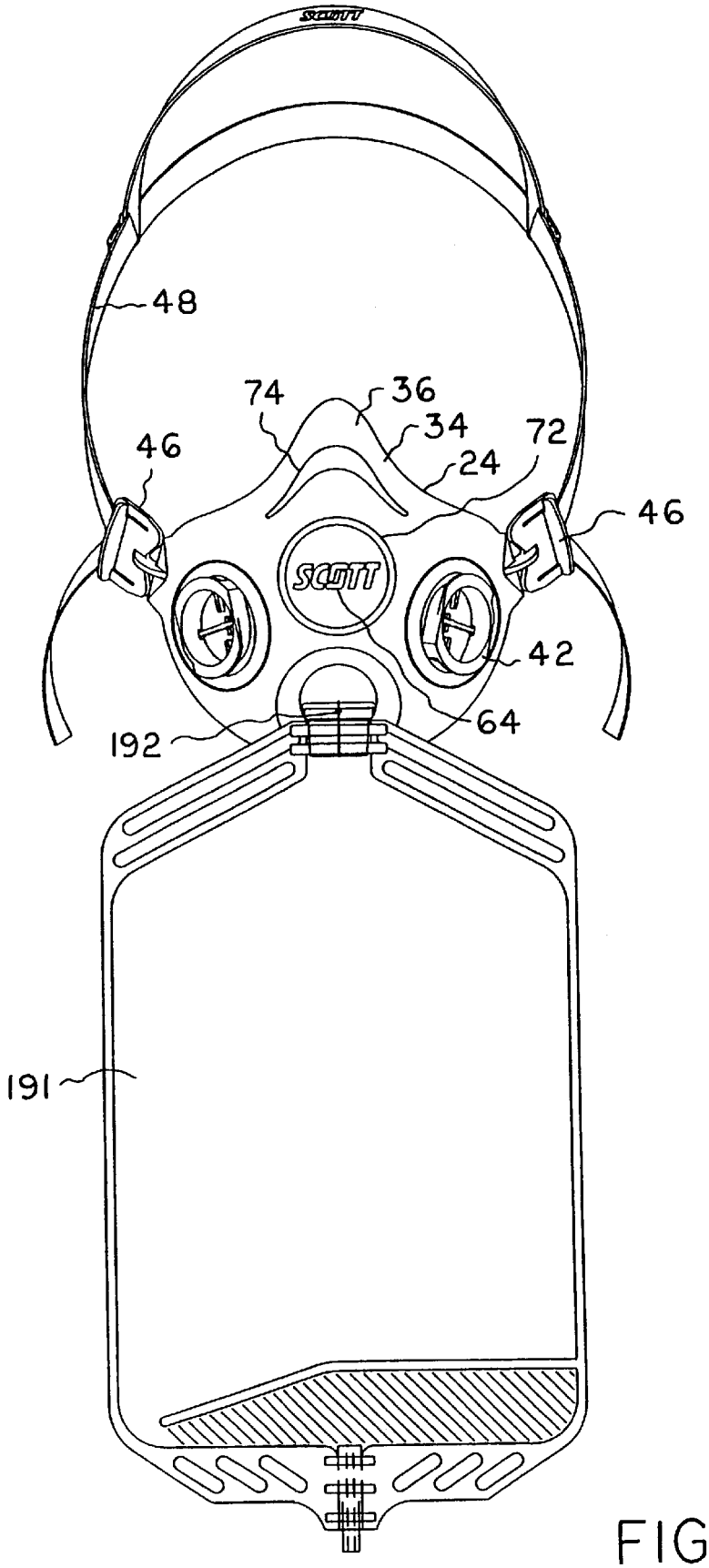
FIG. 14 is a perspective view of an alternate embodiment of the present invention.

Turning to FIG. 14, an alternate embodiment of the present invention provides a source of breathable gas that attaches to the mask 20 of the present invention as a substitution for the air purifying cartridges 22. As will be evident to those of ordinary skill in the art, the mask 20 is easily adaptable for use with a reservoir bag 191 and a coupling member 192 as described and shown in U.S. Pat. No. 5,408,995 which is hereby incorporated by reference.

Thus, there is provided in accordance with the present invention a mask wherein a one-piece insert can be economically molded flat then bent to the desired shape and a body of pliable material molded thereto. The reduction in the number of pieces which would have to be molded separately offers an economic advantage. The mask with the living hinges and the pliable body has the flexibility to fit different faces yet has the rigidity to prevent collapse. The flexible hinges on the buckles allow the harness to adjust to different face sizes. Thus, the mask may be produced inexpensively to be versatile as well as reliable.

It should be understood that, while the invention has been described in detail herein, the invention can be embodied otherwise without departing from the principles thereof, and such other embodiments are meant to come within the scope of the present invention as defined by the following claims.

We claim:

1. A facepiece insert, comprising:

a central portion;

a pair of cheek portions disposed on opposite sides of the central portion and connected to the central portion by living hinges; and a chin portion connected to the central portion by a living hinge.

2. The facepiece insert of claim 1, wherein the insert has at least one intake opening surrounded by an adapter and has at least one exhaust opening.

3. The facepiece insert of claim 2, wherein the adapter is capable of mating with at least one air purifying cartridge.

4. The facepiece insert of claim 2, wherein the adapter is capable of mating with a source of breathable gas.

5. The facepiece insert of claim 2, wherein the adapter is capable of mating with a reservoir bag.

6. The facepiece insert of claim 1, wherein the insert has an aperture with a valve adapted for the egress of exhaust gases.

7. The facepiece insert of claim 1, wherein the central portion, cheek portions, and chin portion are substantially rigid.

8. The facepiece insert of claim 1, further comprising:

at least one harness adjuster attached to each of the cheek portions of the insert.

9. The facepiece insert of claim 8, wherein the harness adjuster further comprises a connecting portion attached to the insert, a planar portion disposed in spaced apart relation to the connecting portion and capable of receiving a strap, and a flexible member extending between the connecting portion and the planar portion, the flexible member having a thickness in a direction normal to the planar portion that is greater than its thickness in a plane parallel to the planar portion.

10. The facepiece insert of claim 9, wherein the flexible member is substantially arcuate along its edge.

11. The facepiece insert of claim 1, wherein the insert is substantially flat.

12. The facepiece insert of claim 1, wherein the insert is formed out of a plastic mixture.

13. The facepiece insert of claim 12, wherein the plastic mixture includes polypropylene.

14. The facepiece of claim 1, wherein the central portion has integrally formed advertising indicia.

15. A respiratory mask, comprising:

a facepiece insert comprising:

a central portion;

a pair of cheek portions disposed on opposite sides of the central portion and connected to the central portion by living hinges; and a chin portion connected to the central portion by a living hinge, the insert having at least one opening surrounded by an adapter;

a facepiece that is formed out of a soft flexible material and that adheres to the facepiece insert.

16. The respiratory mask of claim 15, wherein the adapter is capable of mating with an air purifying cartridge.

17. The respiratory mask of claim 15, wherein the adapter is capable of mating with a source of breathable gas.

18. The respiratory mask of claim 15, wherein the adapter is capable of mating with a reservoir bag.

19. The respiratory mask of claim 15, further comprising:

at least one harness adjuster attached to each of the cheek portions of the insert.

20. The facepiece insert of claim 19, wherein the harness adjuster further comprises a connecting portion attached to the insert, a planar portion disposed in spaced apart relation to the connecting portion and capable of receiving a strap, and a flexible member extending between the connecting portion and the planar portion, the flexible member having a thickness in a direction normal to the planar portion that is greater than its thickness in a plane parallel to the planar portion.

21. The facepiece insert of claim 20, wherein the flexible member is substantially arcuate along its edge.

22. The respiratory mask of claim 15, wherein the insert is formed from a plastic material.

23. The respiratory mask of claim 15, wherein the facepiece material comprises an elastomer selected from the group consisting of Sanoprene and Kraton.

24. A method of forming a respiratory mask, comprising the steps of:

providing a facepiece insert comprising:

a central portion;

a pair of cheek portions disposed on opposite sides of the central portion and connected to the central portion by living hinges; and a chin portion connected to the central portion by a living hinge, the insert having at least one opening surrounded by an adapter;

molding a facepiece material in sealing engagement around the insert.

* * * * *